US011330840B2

(12) United States Patent
Fernando et al.

(10) Patent No.: US 11,330,840 B2
(45) Date of Patent: May 17, 2022

(54) SHISHA DEVICE WITH AIR PREHEAT WITHOUT COMBUSTION

(71) Applicant: PHILIP MORRIS PRODUCTS S.A., Neuchâtel (CH)

(72) Inventors: Felix Fernando, Old Basing (GB); Michael Paton, Royston (GB); David Cross, Willian (GB); Eva Saade Latorre, Colombier (CH); Terence John Wilby, Melbourn (GB)

(73) Assignee: Philip Morris Products S.A., Neuchatel (CH)

( * ) Notice: Subject to any disclaimer, the term of this patent is extended or adjusted under 35 U.S.C. 154(b) by 220 days.

(21) Appl. No.: 16/621,087

(22) PCT Filed: Jun. 26, 2018

(86) PCT No.: PCT/IB2018/054717
§ 371 (c)(1),
(2) Date: Dec. 10, 2019

(87) PCT Pub. No.: WO2019/003116
PCT Pub. Date: Jan. 3, 2019

(65) Prior Publication Data

US 2020/0196662 A1 Jun. 25, 2020

(30) Foreign Application Priority Data

Jun. 28, 2017 (EP) ..... 17178421

(51) Int. Cl.
*A24F 13/00* (2006.01)
*A24F 40/20* (2020.01)
(Continued)

(52) U.S. Cl.
CPC ..... *A24F 40/20* (2020.01); *A24F 1/30* (2013.01); *A24F 40/465* (2020.01); *A24F 40/57* (2020.01)

(58) Field of Classification Search
CPC ..... A24F 47/00
(Continued)

(56) References Cited

U.S. PATENT DOCUMENTS 4,133,318 A 1/1979 Gross et al.
7,350,721 B2 4/2008 Ghazarian
(Continued)

FOREIGN PATENT DOCUMENTS

CN 206025198 U 3/2017
DE 10212045 10/2003
(Continued)

OTHER PUBLICATIONS

Extended European Search Report issued for EP Application No. 17178421.8, dated Oct. 9, 2017 by the European Patent Office; 9 pgs.
(Continued)

*Primary Examiner* — Phuong K Dinh
(74) *Attorney, Agent, or Firm* — Mueting Raach Gebhardt

(57) ABSTRACT

A shisha device article includes a vessel and an aerosol-generating element. The vessel defines an interior configured to contain a volume of liquid. The vessel also includes a head space outlet. The aerosol-generating element is in fluid connection with the vessel. The aerosol-generating element includes (i) a cartridge receptacle for receiving a cartridge containing an aerosol-generating substrate; (ii) a heating element defining at least two surfaces of the cartridge receptacle; and (iii) an aerosol outlet in fluid connection with the cartridge receptacle and a fresh air inlet channel in fluid connection with the cartridge receptacle. The fresh
(Continued)

air inlet channel is arranged to preheat air prior to the air entering the cartridge receptacle.

19 Claims, 3 Drawing Sheets

(51) Int. Cl.
*A24F 40/465* (2020.01)
*A24F 1/30* (2006.01)
*A24F 40/57* (2020.01)

(58) Field of Classification Search
USPC ..... 131/328–329
See application file for complete search history.

(56) References Cited

U.S. PATENT DOCUMENTS

| | | | | |
|---|---|---|---|---|
| 8,905,038 | B2 | 12/2014 | Lotringer | |
| 10,517,331 | B2 * | 12/2019 | Atkins | A24F 40/40 |
| 2007/0102013 | A1 | 5/2007 | Adams et al. | |
| 2008/0302374 | A1 | 12/2008 | Wengert et al. | |
| 2014/0182606 | A1 | 7/2014 | Lotringer | |
| 2016/0165954 | A1 | 6/2016 | Hovespian | |
| 2016/0192702 | A1 | 7/2016 | Ugurhan | |
| 2016/0206001 | A1 | 7/2016 | Eng et al. | |

FOREIGN PATENT DOCUMENTS

| | | | |
|---|---|---|---|
| DE | 10 2015 121435 | A1 | 5/2017 |
| EP | 2883464 | A1 | 6/2015 |
| RU | 2600915 | | 10/2016 |
| WO | WO 2006/085126 | A1 | 8/2006 |
| WO | WO 2013/040193 | A2 | 3/2013 |
| WO | 20140102091 | | 7/2014 |
| WO | WO 2014/102092 | A1 | 7/2014 |
| WO | WO 2015/024697 | A1 | 2/2015 |
| WO | WO 2015/177255 | A1 | 11/2015 |

OTHER PUBLICATIONS

International Search Report and Written opinion issued for PCT/IB2018/054717, dated Oct. 18, 2018 by the European Patent Office; 16 pgs.

International Preliminary Report on Patentability issued for PCT/IB2018/054717, dated May 29, 2019 by the European Patent Office; 15 pgs.

Russian Office Action for RU2019142119 issued by the Russian Federation dated Aug. 12, 2021; 18 pgs. including English Translation.

* cited by examiner

SHISHA DEVICE WITH AIR PREHEAT WITHOUT COMBUSTION

This application is the § 371 U.S. National Stage of International Application No. PCT/IB2018/054717, filed 26 Jun. 2018, which claims the benefit of European Application No. 17178421.8, filed 28 Jun. 2017.

The present disclosure relates to shisha devices and in particular to shisha devices configured to preheat inlet air; more particularly, to shisha devices that preheat air and that heat an aerosol generating substrate without combusting the substrate.

Shisha devices are used to smoke tobacco and are configured such that vapor and smoke pass through a water basin before inhalation by a consumer. Shisha devices may include one outlet or more than one outlet so that the device can be used by more than one consumer at a time. Use of shisha devices is considered by many to be a leisure activity and a social experience.

The tobacco used in shisha devices may be mixed with other ingredients to, for example, increase the volume of the vapour and smoke produced, to alter flavour, or both. Charcoal pellets are typically used to heat the tobacco in a shisha device, which may cause full or partial combustion of the tobacco or other ingredients.

Some shisha devices have been proposed that use electrical heat sources to combust the tobacco to, for example, avoid by-products of burning charcoal or to improve the consistency with which the tobacco is combusted. Other shisha devices have been proposed that employ e-liquids rather than tobacco. Shisha devices that employ e-liquids eliminate combustion by-products, but deprive shisha consumers of the tobacco-based experience.

It is desirable to provide a shisha device that employs a substrate that does not result in combustion by-products.

It is also desirable to provide a shisha device configured for use with an aerosol-generating substrate, such as a tobacco substrate, in a convenient consumable form.

It is also desirable to provide a shisha device that provides an expected shisha experience.

In various aspects of the present invention there is provided a shisha device comprising a vessel and an aerosol-generating element in fluid communication with the vessel. The vessel comprises a head space outlet. The aerosol-generating element comprises a cartridge receptacle, a heating element, an aerosol outlet, and a fresh air inlet channel. The receptacle is configured to receive a cartridge containing an aerosol-generating substrate. The heating element defines at least two surfaces of the cartridge receptacle. Preferably, the heating element defines a top wall portion and a side-wall portion of the cartridge receptacle. Preferably, the side-wall portion of the receptacle is cylindrical. Preferably, the receptacle defines a cylinder shape or frusto-conical shape having a base diameter value being about 1.5 to about 5 times the height value; or having a height that is about 1.5 to about 5 times the base diameter value. The aerosol outlet is in fluid communication with the cartridge receptacle. The fresh air inlet channel is in fluid communication with the cartridge receptacle. The fresh air inlet channel is arranged to preheat air prior to the air entering the cartridge receptacle. Preferably, the heating element defines at least one surface of the fresh air channel. Preferably, at least one surface of the fresh air channel is defined by a receptacle forming surface or an inner surface of the heating element.

In various aspects of the present invention there is provided a shisha assembly comprising a shisha device as described above and a cartridge containing an aerosol-generating substrate received with the cartridge receptacle of the shisha device. Preferably, the cartridge comprises two or more apertures in the base and top surfaces. Preferably, the heating element is configured to heat but not combust the aerosol-generating substrate to provide a combustion-free mainstream aerosol for inhalation by a consumer.

In various aspects of the present invention there is provided an aerosol-generating element for a shisha device. The aerosol-generating element comprises a cartridge receptacle, a heating element, an aerosol outlet, and a fresh air inlet channel. The receptacle is configured to receive a cartridge containing an aerosol-generating substrate. The heating element defines at least two surfaces of the cartridge receptacle. The aerosol outlet is in fluid communication with the cartridge receptacle. The fresh air inlet channel is in fluid communication with the cartridge receptacle. The fresh air inlet channel is arranged to preheat air prior to the air entering the cartridge receptacle. Preferably, the heating element defines at least one surface of the fresh air channel.

Various aspects or embodiments of the shisha devices described herein may provide one or more advantages relative to existing shisha devices. For example, one or more shisha devices described herein may provide high efficiency heating to the aerosol-generating substrate. In some examples, fresh inlet air flowing through the fresh air inlet channel is heated prior to entering the cartridge to entrain aerosol generated from the substrate, which may result in substantially less energy use to aerosolize of the substrate. Because the air is preheated, less energy may be needed to sufficiently heat the aerosol-generating substrate to produce an aerosol. An example of another advantage is the highly uniform heat distribution to the aerosol-generating substrate that may be provided by one or more shisha devices described herein. Yet another example of an advantage is that some examples of the cartridges employed in the shisha devices described herein in provide a convenient consumable form, enabling simple and clean disposal once consumed. The use of an external surface of the heater to preheat air advantageously cools the external surface of the heater, which allows for less insulation to be used around the external surface of the heater. This can be particularly useful in warmer climates, wherein more insulation is typically required to prevent overheating of the heater, the substrate, or the heater and the substrate.

A shisha device of the present invention may comprise any suitable aerosol generating element. The aerosol generating element comprises a cartridge receptacle, a heating element, an aerosol outlet, and a fresh air inlet. The cartridge receptacle is configured to receive a cartridge containing aerosol generating substrate. The heating element defines at least two surfaces of the receptacle. For example, the heating element may form at least a portion of two or more of a top surface, a side surface, and a bottom surface. Preferably, the heating element defines at least a portion of the top surface and at least a portion of a side surface. More preferably, the heating element forms the entire top surface and an entire side wall surface of the receptacle. The heating element may be disposed on an inner surface or an outer surface of the receptacle.

Any suitable heating element may be employed. For example, the heating element may comprise one or both of resistive and inductive heating components. Preferably, the heating element comprises a resistive heating component. For example, the heating element may comprise one or more resistive wires or other resistive elements. The resistive wires may be in contact with a thermally conductive material to distribute heat produced over a broader area. Examples of suitable conductive materials include aluminium, copper, zinc, nickel, silver, and combinations thereof. For purposes of this disclosure, if resistive wires are in contact with a thermally conductive material, both the resistive wires and the thermally conductive material are part of the heating element that forms at least a portion of the surface of the cartridge receptacle.

In some examples, a heating element comprises an inductive heating element. For example, the heating element may comprise a susceptor material that forms a surface of the cartridge receptacle. As used herein, the term 'susceptor' refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact or close thermal proximity with the aerosol-forming substrate, the substrate is heated by the susceptor such that an aerosol is formed. Preferably, the susceptor is arranged at least partially in direct physical contact with the aerosol-forming substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example ferritic iron, a ferromagnetic alloy, such as ferromagnetic steel or stainless steel, and ferrite. A suitable susceptor may be, or comprise, aluminium.

Preferred susceptors are metal susceptors, for example stainless steel. However, susceptor materials may also comprise or be made of graphite, molybdenum, silicon carbide, aluminium, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

A susceptor preferably comprises more than 5%, preferably more than 20%, preferably more than 50% or 90% of ferromagnetic or paramagnetic materials. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core.

In the system according to the invention, the base and the at least one side wall of the cartridge receptacle may comprise susceptor material. Preferably, base and the at least one side wall comprise susceptor material. Advantageously, at least portions of an outer surface of the cartridge receptacle are made of susceptor material. However, also at least portions of an inner side of the cartridge receptacle may be coated or lined with susceptor material. Preferably, a lining is attached or fixed to the shell such as to form an integral part of the shell.

In addition, or alternatively, the cartridge may comprise a susceptor material.

The shisha device may also comprise one or more induction coil configured to induce eddy currents and/or hysteresis losses in a susceptor material, which results in heating of the susceptor material. A susceptor material may also be positioned in the cartridge containing the aerosol generating substrate. A susceptor element comprising the susceptor material may comprise any suitable material, such as those described in, for example, PCT Published Patent Applications WO 2014/102092 and WO 2015/177255.

The shisha device may comprise control electronics operably coupled to the resistive heating element or induction coil. The control electronics are configured to control heating of the heating element.

The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may comprise a microprocessor, which may be a programmable microprocessor. The electronic circuitry may be configured to regulate a supply of power. The power may be supplied to the heater element or induction coil in the form of pulses of electrical current.

If the heating element is a resistive heating element, the control electronics may be configured to monitor the electrical resistance of the heating element and to control the supply of power to the heating element depending on the electrical resistance of the heating element. In this manner, the control electronics may regulate the temperature of the resistive element.

If the heating components comprise an induction coil and the heating element comprises a susceptor material, the control electronics may be configured to monitor aspect of the induction coil and to control the supply of power to the induction coil depending on the aspects of the coil such as described in, for example, WO 2015/177255. In this manner, the control electronics may regulate the temperature of the susceptor material.

The shisha device may comprise a temperature sensor, such as a thermocouple, operably coupled to the control electronics to control the temperature of the heating elements. The temperature sensor may be positioned in any suitable location. For example, the temperature sensor may be configured to insert into a cartridge received within the receptacle to monitor the temperature of the aerosol-generating substrate being heated. In addition or alternatively, the temperature sensor may be in contact with the heating element. In addition or alternatively, the temperature sensor may be positioned to detect temperature at an aerosol outlet of the shisha device, such as the aerosol outlet of the aerosol-generating element. The sensor may transmit signals regarding the sensed temperature to the control electronics, which may adjust heating of the heating elements to achieve a suitable temperature at the sensor.

Regardless of whether the shisha device includes a temperature sensor, the device is preferably configured to heat an aerosol generating substrate in a cartridge received in the receptacle to an extent sufficient to generate an aerosol without combusting the aerosol generating substrate.

The control electronics may be operably coupled to a power supply. The shisha device may comprise any suitable power supply. For example, a power supply of a shisha device may be a battery, or set of batteries. In some examples, the cathode and anode elements can be rolled and assembled to match geometries of a portion of a shisha device in which they are disposed. The batteries of power supply unit can be rechargeable, as well as it may be removable and replaceable. Any suitable battery may be used. For example, heavy duty type or standard batteries existing in the market, such as used for industrial heavy duty electrical power-tools. Alternatively the power supply unit can be any type of electric power supply including a super or hyper-capacitor. Alternatively the device can be powered connected to an external electrical power source, and electrically and electronically designed for such purpose. Regardless of the type of power supply employed, the power supply preferably provides sufficient energy for the normal functioning of the device for approximately 70 minutes of continuous operation of the device, before being recharged or needing to connect to an external electrical power source.

The shisha device comprises a fresh air inlet channel in fluid connection with the cartridge receptacle. Fresh air flows through the channel to the cartridge receptacle and the cartridge disposed into the receptacle to carry aerosol generated from the aerosol generating substrate in the cartridge to the aerosol outlet when the shisha device is in use. At least a portion of the channel is formed by a heating element to preheat the air prior to entering the cartridge receptacle or cartridge. Preferably, a portion of the heating element that forms a surface of the cartridge receptacle forms a portion of the fresh air inlet channel. Preferably the fresh air inlet channel is formed from one or both of the top surface of the cartridge receptacle and a side wall of the cartridge receptacle that is formed by the heating element. Preferably, the air inlet channel is formed by both the top surface of the cartridge receptacle and a side wall of the cartridge receptacle that if formed by the heating element. Preferably, an external surface of the heating element forms at least a portion of the air inlet channel. An external surface of the heating element is a surface of the heating element that is opposite the surface of the heating element that forms the receptacle.

Any suitable portion of the air inlet channel may be formed by the heating element. Preferably, about 50% or more of the length of the air inlet channel is formed by the heating element. In many examples, the heating element will form 95% or less of the length of the fresh air inlet channel.

Air flowing through the fresh air inlet channel may be heated by any suitable amount by the heating element. In some examples, the air will be sufficiently heated to cause an aerosol to form when the heated air flows through a cartridge containing aerosol generating substrate. In some examples, the air is not sufficiently heated to cause aerosol formation on its own, but facilitates heating of the substrate by the heating elements. Preferably, the amount of energy supplied to the heating elements to heat the substrate and cause aerosol formation is reduced by 5% or more, such as 10% or more, or 15% or more, when the air is pre-heated in accordance with the present invention, relative to designs in which air is not pre-heated. Typically, the energy savings will be less than 75%.

The substrate is preferably heated, through a combination of the preheated air and heating from the heating elements, to a temperature in a range from about 150° C. to about 300° C.; more preferably from about 180° C. to about 250° C. or from about 200° C. to about 230° C.

To achieve such substrate temperatures, the heating element may be heated to a working temperature from about 150° C. to about 250° C.; preferably from about 180° C. to about 230° C. or from about 200° C. to about 230° C.

Preferably, the temperature of air in the air inlet quickly responds to the temperature of the heating element. For example, the temperature of the air in the air inlet at a location formed by the heating element achieves a temperature of within 35° C. of the temperature of the heating element within three seconds of initiating heating of the heating element. In some embodiments, the temperature of the air in the air inlet at a location formed by the heating element achieves a temperature of within 35° C. of the temperature of the heating element within three seconds of the heating element reaching a working temperature. In some embodiments, the temperature of the air in the air inlet at a location formed by the heating element achieves a temperature of within 35° C. of the temperature of the heating element within three seconds during a period of time when the device is in use, such as between a user puffing on the device.

More preferably, the temperature of the air in the air inlet channel at the location of the heating element achieves a temperature of with 25° C. of the temperature of the heating element within two seconds initiating heating of the heating element. In some embodiments, the temperature of the air in the air inlet at a location formed by the heating element achieves a temperature of within 25° C. of the temperature of the heating element within two seconds of the heating element reaching the working temperature. In some embodiments, the temperature of the air in the air inlet at a location formed by the heating element achieves a temperature of within 25° C. of the temperature of the heating element within two seconds during a period of time whilst the device is in use, for example, between a user puffing on the device. Even more preferably, the temperature of the air in the air inlet channel at the location of the heating element achieves a temperature of with 15° C. of the temperature of the heating element within 1 seconds of initiating heating of the heating element. In some embodiments, the temperature of the air in the air inlet at a location formed by the heating element achieves a temperature of within 15° C. of the temperature of the heating element within one second of the heating element reaching the working temperature. In some embodiments, the temperature of the air in the air inlet at a location formed by the heating element achieves a temperature of within 15° C. of the temperature of the heating element within one second of the heating element during a period of time when the device is in use, such as between a user puffing on the device.

In some embodiments, the temperature of the air in the air inlet channel at the location of the heater air temperature may reach at least 110° C. within the first 5 seconds after initiating heating of the heating element. Preferably, the temperature of the air in the air inlet channel at the location of the heater air temperature may reach at least 110° C. within the first 3 seconds after initiating heating of the heating element. Preferably, the temperature of the air in the air inlet channel at the location of the heater air temperature may reach at least 110° C. within the first 1.5 seconds after initiating heating of the heating element.

In some embodiments, the temperature of the air in the air inlet channel at the location of the heater air temperature may reach at least 190° C. within the first 5 seconds after initiating heating of the heating element. Preferably, the temperature of the air in the air inlet channel at the location of the heater air temperature may reach at least 190° C. within the first 3 seconds after initiating heating of the heating element. Preferably, the temperature of the air in the air inlet channel at the location of the heater air temperature may reach at least 190° C. within the first 1.5 seconds after initiating heating of the heating element.

In some embodiments, the temperature of the air in the air inlet channel at the location of the heater air temperature may reach at least 200° C. within the first 5 seconds after initiating heating of the heating element. Preferably, the temperature of the air in the air inlet channel at the location of the heater air temperature may reach at least 200° C. within the first 3 seconds after initiating heating of the heating element. Preferably, the temperature of the air in the air inlet channel at the location of the heater air temperature may reach at least 200° C. within the first 1.5 seconds after initiating heating of the heating element.

In some embodiments, the temperature of the air in the air inlet channel at the location of the heater air temperature may reach at least 110° C. within 5 seconds of the heating element reaching the working temperature. Preferably, the temperature of the air in the air inlet channel at the location of the heater air temperature may reach at least 110° C. within 3 seconds of the heating element reaching the working temperature. Preferably, the temperature of the air in the air inlet channel at the location of the heater air temperature may reach at least 110° C. within 1.5 seconds of the heating element reaching the working temperature.

In some embodiments, the temperature of the air in the air inlet channel at the location of the heater air temperature may reach at least 190° C. within 5 seconds of the heating element reaching the working temperature. Preferably, the temperature of the air in the air inlet channel at the location of the heater air temperature may reach at least 190° C. within 3 seconds of the heating element reaching the working temperature. Preferably, the temperature of the air in the air inlet channel at the location of the heater air temperature may reach at least 190° C. within 1.5 seconds of the heating element reaching the working temperature.

In some embodiments, the temperature of the air in the air inlet channel at the location of the heater air temperature may reach at least 200° C. within 5 seconds of the heating element reaching the working temperature. Preferably, the temperature of the air in the air inlet channel at the location of the heater air temperature may reach at least 200° C. within 3 seconds of the heating element reaching the working temperature. Preferably, the temperature of the air in the air inlet channel at the location of the heater air temperature may reach at least 200° C. within 1.5 seconds of the heating element reaching the working temperature.

In use, one or more users may use a shisha device, taking puffs.

Preferably, the temperature of the air in the air inlet channel at the location of the heater following a puff returns to a pre-puff temperature within about three seconds after the puff. Preferably, the temperature of the air in the air inlet channel at the location of the heater following a puff returns to the pre-puff temperature within about two seconds or within about 1 second after a puff.

It will be appreciated that puffing behaviors, such as duration of each puff, frequency of puffing may vary amongst users. A typical puff may last between 2 and 3 seconds, although some users may take puffs having a longer or a shorter duration.

Preferably at least a portion of the air flow channel is formed between the heating element and a heat shield. Preferably, substantially the entire portion of the fresh air inlet channel that is formed by the fresh air inlet channel is also formed by the heat shield. The heat shield and the heating element may form opposing surfaces of the fresh air inlet channel, such that the air flows between the heat shield and the heating element. Preferably, the heat shield is positioned exterior to an interior formed by the cartridge receptacle.

Any suitable heat shield material may be employed. Preferably, the heat shield material comprises a surface that is thermally reflective. The thermally reflective surface may be backed with an insulating material. In some examples, the thermally reflective material comprises an aluminium metalized film or other suitable thermally reflective material. In some examples, the insulating material comprises a ceramic material. In some examples, the heat shield comprises an aluminium metalized film and a ceramic material backing.

The fresh air inlet channel may comprise one or more apertures through the cartridge receptacle such that fresh air from outside the shisha device may flow through the channel and into the cartridge receptacle through the apertures. If a channel comprises more than one aperture, the channel may comprise a manifold to direct air flowing through the channel to each aperture. Preferably, the shisha device comprises two or more fresh air inlet channels.

The cartridge receptacle may comprise any suitable number of apertures in communication with one or more fresh air inlet channels. For example, the receptacle may comprise 1 to 1000 apertures, such as 10 to 500 apertures. The apertures may be of uniform size or non-uniform size. The apertures may be uniformly distributed or non-uniformly distributed. The apertures may be formed in the cartridge receptacle at any suitable location. For example, the apertures may be formed in one or both of a top or a sidewall of the receptacle. Preferably, the apertures are formed in the top of the receptacle.

The receptacle is preferably shaped and sized to allow contact between one or more wall or ceiling of the receptacle and the cartridge when the cartridge is received by the receptacle to facilitate conductive heating of the cartridge and aerosol generating substrate by the heating element forming a surface of the receptacle. In some examples, an air gap may be formed between at least a portion of the cartridge and a surface of the receptacle, where the air gaps serve as a portion of the fresh air inlet channel.

Preferably, the interior of the cartridge receptacle and the exterior of the cartridge are of similar size and dimensions. Preferably, the interior of the receptacle and the exterior of the cartridge has a height to a base width (or diameter) ratio of greater than about 1.5 to 1 or a base width (or diameter) ratio of greater than about 1.5 to 1. Such ratios may allow for more efficient depletion of the aerosol generating substrate within the cartridge during use by allowing heat from the heating elements to penetrate to the middle of the cartridge. For example, the receptacle and cartridge may have a base diameter (or width) about 1.5 to about 5 times the height, or about 1.5 to about 4 times the height, or about 1.5 to about 3 times the height. Similarly, the receptacle and cartridge may have a height about 1.5 to about 5 times the base diameter (or width), or about 1.5 to about 4 times the base diameter (or width), or about 1.5 to about 3 times the base diameter (or width). Preferably, the receptacle and cartridge have a height to base diameter ratio or base diameter to height ratio of from about 1.5 to 1 to about 2.5 to 1.

In some examples, the interior of the receptacle and the exterior of the cartridge has a height in a range from about 15 mm to about 25 mm and a base diameter in a range from about 40 mm to about 60 mm.

The cartridge receptacle may be formed from one or more parts. Preferably, the receptacle is formed by two or more parts. Preferably, at least one part of the receptacle is movable relative to another part to allow access to the interior of the receptacle for inserting the cartridge into the receptacle. For example, one part may be removably attachable to another part to allow insertion of the cartridge when the parts are separated. The parts may be attachable in any suitable manner, such as through threaded engagement, interference fit, snap fit, or the like. In some examples, the parts are attached to one another via a hinge. When the parts are attached via a hinge, the parts may also include a locking mechanism to secure the parts relative to one another when the receptacle is in a closed position. In some examples, the cartridge receptacle comprises a drawer that may be slid open to allow the cartridge to be placed into the drawer and may be slid closed to allow the shisha device to be used.

Any suitable aerosol generating cartridge may be used with a shisha device as described herein. Preferably, the cartridge comprises a thermally conductive housing. For example, the housing may be formed from aluminium, copper, zinc, nickel, silver, and combinations thereof. Preferably, the housing is formed from aluminium. In some examples, the cartridge is formed from one or more material less thermally conductive than aluminium. For example, the housing may be formed from any suitable thermally stable polymeric material. If the material is sufficiently thin sufficient heat may be transferred through the housing despite the housing being formed from material that is not particularly thermally conductive.

The cartridge comprises one or more apertures formed in the top and bottom of the housing to allow air flow through the cartridge when in use. If the top of the receptacle comprises one or more apertures, at least some of the apertures in the top of the cartridge may aligned with the apertures in the top of the receptacle. The cartridge may comprise an alignment feature configured to mate with a complementary alignment feature of the receptacle to align the apertures of the cartridge with the apertures of the receptacle when the cartridge is inserted into the receptacle. The apertures in the housing of the cartridge may be covered during storage to prevent aerosol generating substrate stored in the cartridge from spilling out of the cartridge. In addition or alternatively, the apertures in the housing may have dimensions sufficiently small to prevent or inhibit the aerosol generating substrate from exiting the cartridge. If the apertures are covered, a consumer may remove the cover prior to inserting the cartridge into the receptacle. In some examples, the receptacle is configured to puncture the cartridge to form apertures in the cartridge. Preferably, the receptacle is configured to puncture the top of the cartridge.

The cartridge may be of any suitable shape. Preferably, the cartridge has a frustro-conical shape.

Any suitable aerosol-generating substrate may be placed in a cartridge for use with shisha devices of the invention. The aerosol-generating substrate is preferably a substrate capable of releasing volatile compounds that may form an aerosol. The volatile compounds may be released by heating the aerosol-generating substrate. The aerosol-generating substrate may be solid or liquid or comprise both solid and liquid components. Preferably, the aerosol-generating substrate is solid.

The aerosol-generating substrate may comprise nicotine. The nicotine containing aerosol-generating substrate may comprise a nicotine salt matrix. The aerosol-generating substrate may comprise plant-based material. The aerosol-generating substrate may comprise tobacco, and preferably the tobacco containing material contains volatile tobacco flavor compounds, which are released from the aerosol-generating substrate upon heating.

The aerosol-generating substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 30% by weight on a dry weight basis. The aerosol-former content may be less than about 95% on a dry weight basis.

The aerosol-generating substrate may alternatively or additionally comprise a non-tobacco-containing material. The aerosol-generating substrate may comprise homogenized plant-based material.

The aerosol-generating substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-generating substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavorants. The aerosol-generating substrate preferably comprises nicotine and at least one aerosol-former. In a particularly preferred embodiment, the aerosol-former is glycerine.

The solid aerosol-forming substrate may be provided on or embedded in a thermally stable carrier. The carrier may comprise a thin layer on which the solid substrate deposited on a first major surface, on second major outer surface, or on both the first and second major surfaces. The carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose derivative fibers.

In some examples, the aerosol generating substrate is in the form of a suspension. For example, the aerosol generating substrate may be in the form of a thick, molasses-like, suspension.

Air that enters the cartridge flows across the aerosol generating substrate, entrains aerosol, and exits the cartridge and receptacle via an aerosol outlet. From the aerosol outlet, the air carrying the aerosol enters a vessel.

The shisha device may comprise any suitable vessel defining an interior volume configured to contain a liquid and defining an outlet in head-space above a liquid fill level. The vessel may comprise an optically transparent or opaque housing to allow a consumer to observe contents contained in the vessel. The vessel may comprise a liquid fill demarcation, such as a liquid fill line. The vessel housing may be formed of any suitable material. For example, the vessel housing may comprise glass or suitable rigid plastic material. Preferably, the vessel is removable from a portion of the shisha device comprising the aerosol-generation element to allow a consumer to fill or clean the vessel.

The vessel may be filled to a liquid fill level by a consumer. The liquid preferably comprises water, which may optionally be infused with one or more colorants, flavorants, or colorant and flavorants. For example, the water may be infused with one or both of botanical or herbal infusions.

Aerosol entrained in air exiting the aerosol outlet of the receptacle may travel through a conduit positioned in the vessel. The conduit may be coupled to the aerosol outlet and may have an opening below the liquid fill level of the vessel, such that aerosol flowing through the vessel flows through the opening of the conduit, then through the liquid, into headspace of the vessel and exits the headspace outlet for delivery to a consumer.

The headspace outlet may be coupled to a hose comprising a mouthpiece for delivering the aerosol to a consumer. The mouthpiece may comprise a switch activatable by a user or a puff sensor operably coupled to the control electronics of the shisha device. Preferably, the switch or puff sensor is wirelessly coupled to the control electronics. Activation of a switch or puff sensor may cause the control electronics to activate the heating element, rather than constantly supplying energy to the heating element. Accordingly, the use of a switch or puff sensor may serve to save energy relative to devices not employing such elements to provide on-demand heating rather than constant heating.

For purposes of example, one method for using a shisha device as described herein is provided below in chronological order. The vessel may be detached from other components of the shisha device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the shisha device. A portion of the aerosol generating element may be removed or opened to allow the cartridge to be inserted into the receptacle. The aerosol generating element is then reassembled or closed. The device may then be turned on. A user may puff from a mouth piece until a desired volume of aerosol is produced to fill the aerosol chamber (defined by the inner volume of the cover). The user may puff on the mouth piece as desired. The user may continue using the device until no more aerosol is visible in the aerosol chamber. Preferably, the device will automatically shut off when the cartridge is depleted of usable aerosol-generating substrate. Alternatively or in addition, the consumer may refill the device with a fresh cartridge after, for example, receiving the cue from the device that the consumables are depleted or nearly depleted. If refilled with a fresh cartridge, the device may continue to be used. Preferably, the shisha device may be turned off at any time by a consumer by, for example, switching off the device.

In some examples, a user may activate one or more heating elements by using an activation element on, for example, the mouthpiece. The activation element may be, for example, in wireless communication with the control electronics and may signal control electronics to activate the heating element from standby mode to full heating. Preferably, such manual activation is only enabled while the user puffs on the mouthpiece to prevent overheating or unnecessary heating of aerosol-generating substrate in the cartridge.

In some examples, the mouthpiece includes a puff sensor in wireless communication with the control electronics and puffing on the mouthpiece by a consumer causes activation of the heating elements from a standby mode to full heating.

A shisha device of the invention may have any suitable air management. In one example, puffing action from the user will create a suction effect causing a low pressure inside the device which will cause external air to flow through air inlet of the device, into the fresh air inlet channel, and into the cartridge receptacle. The air may then flow through to a cartridge in the receptacle to carry aerosol produced from the aerosol generating substrate in the cartridge. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Preferably, assembly of all main parts of a shisha device of the invention assures hermetic functioning of the device. Hermetic function should assure that proper air flow management occurs. Hermetic functioning may be achieved in any suitable manner. For example, seals such as sealing rings and washers maybe used to ensure hermetic sealing.

Sealing rings and sealing washers or other sealing elements may be made of any suitable material or materials. For example, the seals may comprise one or more of graphene compounds and silicon compounds. Preferably, the materials are approved for use in humans by the U.S. Food and Drug Administration.

Main parts, such as the conduit from the receptacle, a cover housing of the receptacle, and the vessel may be made of any suitable material or materials. For example, these parts may independently be made of glass, glass-based compounds, polysulfone (PSU), polyethersulfone (PES), or polyphenylsulfone (PPSU). Preferably, the parts are formed of materials suitable for use in standard dish washing machines.

In some examples, a mouthpiece of the invention incorporates a quick coupling male/female feature to connect to a hose unit.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1:
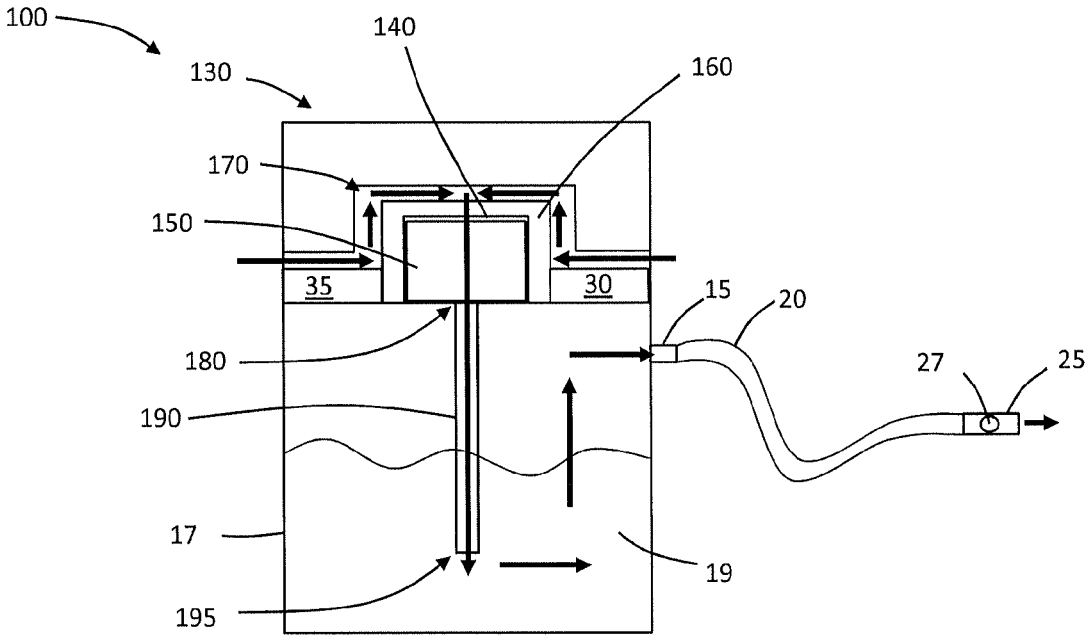
FIG. 1 is a schematic sectional view of an example of a shisha device.

Referring now to FIG. 1, a schematic sectional drawing of an example of a shisha device 100 is shown. The device 100 includes a vessel 17 defining an interior volume configured to contain liquid 19 and defining a headspace outlet 15 above a fill level for the liquid 19. The liquid 19 preferably comprises water, which may optionally be infused with one or more colorants, one or more flavorants, or one or more colorants and one or more flavorants. For example, the water may be infused with one or both of botanical infusions or herbal infusions.

The device 100 also includes an aerosol-generating element 130. The aerosol-generating element 130 includes a cartridge receptacle 140 configured to receive a cartridge 150 containing an aerosol-generating substrate. The aerosol-generating element 130 also includes a heating element 160 that forms at least two surfaces of the receptacle 140. In the depicted embodiment, the heating element 160 defines the top and side surfaces of the receptacle 140. The aerosol-generating element 130 also includes a fresh air inlet channel 170 that draws fresh air into the device 100. A portion of the fresh air inlet channel 170 is formed by the heating element 160 to heat the air before the air enters the receptacle 140. The pre-heated air then enters the cartridge 150, which is also heated by heating element 160, to carry aerosol generated by aerosol generating substrate in the cartridge 150. The air exits the aerosol outlet 180 of the aerosol-generating element 130.

A conduit 190 carries the air and aerosol from the aerosol outlet 180 into the vessel 17 below the level of the liquid 19. The air and aerosol may bubble through the liquid 19 and exit the headspace outlet 15. A hose 20 may be attached to the headspace outlet 15 to carry the aerosol to the mouth of a user. A mouthpiece 25 may be attached or form a part of the hose 20.

The air flow path of the device, in use, is depicted by thick arrows in FIG. 1.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 140.

The control electronics 30 and power supply 35 may be located in any suitable position of the aerosol generating element 130 other than the bottom portion of the element 130 as depicted in FIG. 1.

Figure 2:
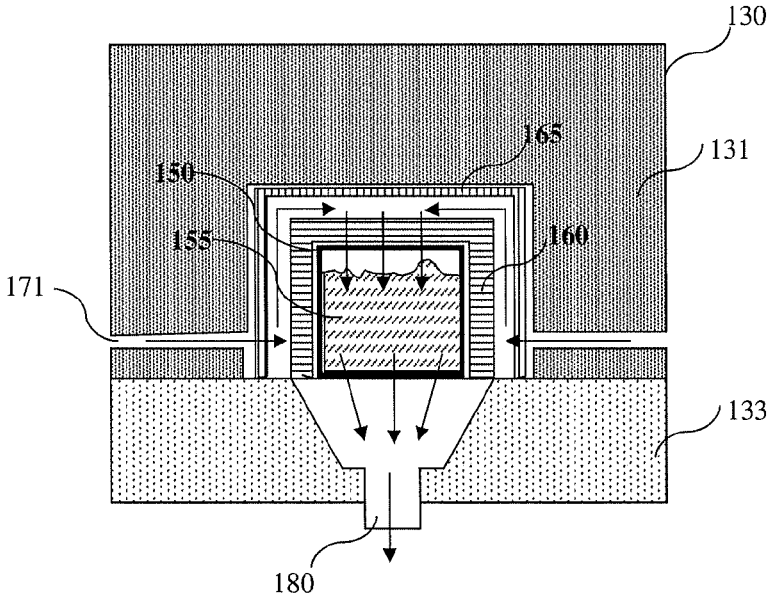
FIG. 2 is a schematic sectional view of an example of an aerosol-generating element.

FIG. 2 shows a schematic sectional view of an example of an aerosol-generating element 130. Not all components are shown for purposes of brevity and clarity. In the illustrated embodiment, air (arrows) enters in air inlets 171 in an upper part 131 of the aerosol-generating element 130, then passes through a heat shield 165, then follows the outside surface of the heating element 160 and arrives to the top of the heating element 160. The heated air then goes through a top surface of a housing of the cartridge 150, through the aerosol-generating substrate 155, and through a void in a bottom part 133, down to the aerosol outlet 180. In the depicted embodiment, the air travels along the outer surface of the heating element 160 and then through the heating element 160.

In the example depicted in FIG. 2, the upper part 131 may be removed from the lower part 133 to allow the cartridge 150 to be inserted or removed from the receptacle formed by the heating element 160 and the top surface of the bottom part 131.

Figure 3:
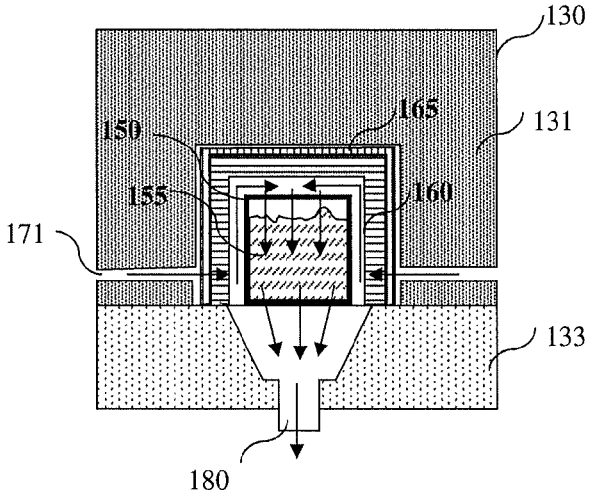
FIG. 3 is a schematic sectional view of an example of an aerosol-generating element.

FIG. 3 shows a schematic sectional view of an example of an aerosol-generating element 130. Not all components are shown for purposes of brevity and clarity. In the illustrated embodiment, air (arrows) enters in air inlets 171 in an upper part 131 of the aerosol-generating element 130, then passes through a heat shield 165 and heating element 160. The air then follows the inside surface of the heating element 160 and an outer surface of the housing of the cartridge 150, and arrives to the top of the housing of the cartridge 150. The heated air then goes through a top surface of a housing of the cartridge 150, through the aerosol-generating substrate 155, and through a void in a bottom part 133, down to the aerosol outlet 180. In the depicted embodiment, the air travels through the heating element 160 and along the inner surface of the heating element 160.

In the example depicted in FIG. 3, the upper part 131 may be removed from the lower part 133 to allow the cartridge 150 to be inserted or removed from the receptacle formed by the heating element 160 and the top surface of the bottom part 131.

In the examples depicted in FIGS. 2-3, the bodies of the upper part 131 may be formed from thermally insulating material.

Figure 4:
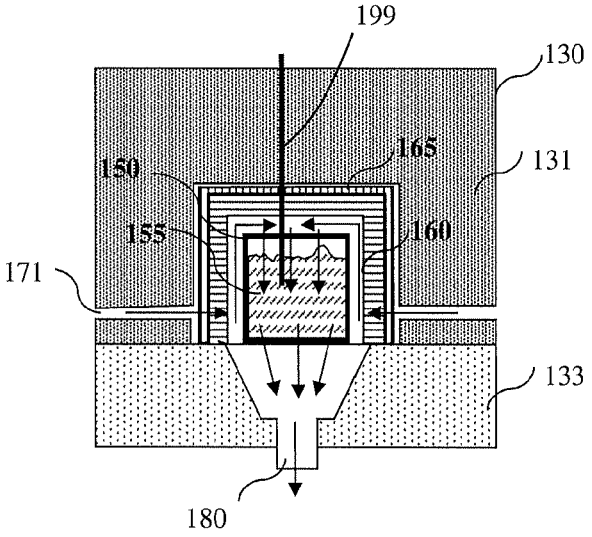
FIG. 4 is a schematic sectional view of an aerosol-generating element including a thermocouple.

In the embodiment, depicted in the schematic sectional view of FIG. 4 the aerosol-generating element 130 includes a thermocouple 199 operably coupled to control electronics (not shown in FIG. 4). In the depicted example, the thermocouple 199 penetrates into the cartridge 150 and aerosol generating substrate 155. The thermocouple 199 may penetrate into the cartridge 150 when the cartridge 150 is positioned on the bottom part 133 and the upper part 131 is placed over the bottom part 131. The thermocouple 199 may be in contact with the heating element 160, in proximity to the outlet 180, or in any other suitable location to provide feedback of a relevant temperature when the shisha device is in use.

Figure 5:
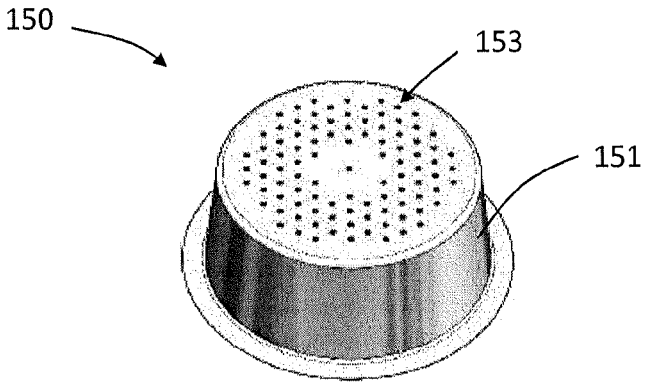
FIG. 5 is a schematic perspective view of an example of a cartridge that may be used with a shisha device.

Referring now to FIG. 5, a schematic perspective view of an example of a cartridge 150 that may be used with a shisha device described herein is shown. The cartridge 150 includes a housing 151 and a plurality of apertures 153 formed in the top surface of the housing to allow air flow through the cartridge 150 and aerosol generating substrate contained in the housing. The bottom of the cartridge 150 may also contain one or more apertures to allow air flow through the cartridge 150.

In some examples, such as in FIG. 2, where air flows through the top of the receptacle, the top of the receptacle may have a similar distribution of apertures as the cartridge shown in FIG. 5.

The features described above in relation to one aspect of the invention may also be applicable to another aspect of the invention.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

The embodiments exemplified above are not limiting. Other embodiments consistent with the embodiments described above will be apparent to those skilled in the art.

The invention claimed is:

1. A shisha device comprising:

a vessel defining an interior configured to contain a volume of liquid, the vessel comprising a head space outlet; and an aerosol-generating element in fluid connection with the vessel, the aerosol-generating element comprising:

a cartridge receptacle for receiving a cartridge containing an aerosol-generating substrate;

a heating element defining at least two surfaces of the cartridge receptacle; and an aerosol outlet in fluid connection with the cartridge receptacle; and a fresh air inlet channel in fluid connection with the cartridge receptacle, wherein the fresh air inlet channel is arranged to preheat air prior to the air entering the cartridge receptacle.

2. The shisha device according to claim 1, wherein the heating element defines a top wall portion and a cylindrical sidewall portion of the cartridge receptacle.

3. The shisha device according to claim 1, wherein the cartridge receptacle defines a cylinder, the cylinder having a height value and a diameter value and the diameter value is 1.5 to 5 times the height value, or the height value is 1.5 to 5 times the diameter value.

4. The shisha device according to claim 1, wherein the cartridge receptacle defines a frusto-conical shape, the frusto-conical shape having a height value and a base diameter value and the base diameter value is 1.5 to 5 times the height value, or the height value is 1.5 to 5 times the base diameter value.

5. The shisha device according to claim 1, wherein the heating element defines at least one surface of the fresh air inlet channel.

6. The shisha device according to claim 1, wherein the heating element defines a top wall and a cylindrical sidewall portion of the cartridge receptacle and the fresh air inlet channel is at least partially defined by the heating element forming the top wall and the heating element forming the cylindrical sidewall portion of the cartridge receptacle.

7. The shisha device according to claim 1, wherein the fresh air inlet channel is at least partially defined by a receptacle surface of the heating element and a cartridge received within the cartridge receptacle.

8. The shisha device according to claim 1, wherein the fresh air inlet channel is at least partially defined by an inner surface of the heating element and an inner surface of the aerosol-generating element containing the heating element.

9. The shisha device according to claim 1, wherein one or more apertures through the heating element define a portion of the fresh air inlet channel.

10. The shisha device according to claim 2, wherein two or more apertures through the heating element top wall define a portion of the fresh air inlet channel.

11. The shisha device according to claim 1, wherein the heating element comprises a resistive heating element.

12. The shisha device according to claim 1, wherein the heating element comprises an inductive heating element.

13. A shisha assembly comprising:

a shisha device according to claim 1; and a cartridge containing an aerosol-generating substrate, the cartridge containing an aerosol-generating substrate received within the cartridge receptacle of the aerosol-generating element.

14. The shisha assembly according to claim 13, wherein the heating element is configured to heat but not burn the aerosol-generating substrate contained within the cartridge during operation.

15. An aerosol-generating element for a shisha device, comprising:

a cartridge receptacle for receiving a cartridge containing an aerosol-generating substrate;

a heating element defining at least two surfaces of the cartridge receptacle; and an aerosol outlet in fluid connection with the cartridge receptacle and a fresh air inlet channel in fluid connection with the cartridge receptacle, wherein the fresh air inlet channel is arranged to preheat air prior to the air entering the cartridge receptacle.

16. The shisha device according to claim 1, wherein the cartridge receptacle defines a cylinder, the cylinder having a height value and a diameter value and the diameter value is 1.5 to 4 times the height value, or the height value 1.5 to 4 times the diameter value.

17. The shisha device according to claim 1, wherein the cartridge receptacle defines a cylinder, the cylinder having a height value and a diameter value and the diameter value is 1.5 to 3 times the height value, or the height value is 1.5 to 3 times the diameter value.

18. The shisha device according to claim 1, wherein the cartridge receptacle defines a frusto-conical shape, the frusto-conical shape having a height value and a base diameter value and the base diameter value is 1.5 to 4 times the height value, or the height value is 1.5 to 4 times the base diameter value.

19. The shisha device according to claim 1, wherein the cartridge receptacle defines a frusto-conical shape, the frusto-conical shape having a height value and a base diameter value and the base diameter value is 1.5 to 3 times the height value, or the height value is 1.5 to 3 times the base diameter value.

* * * * *